US006074752A

United States Patent [19]

Declercq

[11] Patent Number: 6,074,752

[45] Date of Patent: Jun. 13, 2000

[54] METAL FIBRE AGGLOMERATE AND PROCESS FOR MANUFACTURING THE SAME

[75] Inventor: Dries Declercq, Wevelgem, Belgium

[73] Assignee: N.V. Bekaert S.A., Belgium

[21] Appl. No.: 09/155,013

[22] PCT Filed: Jan. 12, 1998

[86] PCT No.: PCT/EP98/00158

§ 371 Date: Nov. 5, 1998

§ 102(e) Date: Nov. 5, 1998

[87] PCT Pub. No.: WO98/31491

PCT Pub. Date: Jul. 23, 1998

[30] Foreign Application Priority Data

Jan. 17, 1997 [BE] Belgium ..... 9700056

[51] Int. Cl.[7] ..... D02G 3/00; B32B 15/04

[52] U.S. Cl. ..... 428/373; 428/293.1; 428/365; 428/379; 428/396

[58] Field of Search ..... 428/293.1, 365, 428/373, 379, 396; 442/228, 229, 230, 231, 232

[56] References Cited

U.S. PATENT DOCUMENTS

| | | | |
|---|---|---|---|
| 4,249,918 | 2/1981 | Argo et al. | 55/97 |
| 4,265,981 | 5/1981 | Campbell | 428/591 |

FOREIGN PATENT DOCUMENTS

| | | | |
|---|---|---|---|
| 1 483 322 | 6/1967 | France . | |
| 2 567 055 | 1/1986 | France . | |
| 2 053 022 | 2/1981 | United Kingdom . | |
| 93/18912 | 9/1993 | WIPO | B32B 13/02 |

*Primary Examiner*—Blaine Copenheaver
*Assistant Examiner*—Ula C. Ruddock
*Attorney, Agent, or Firm*—Nixon & Vanderhye P.C.

[57] ABSTRACT

The invention relates to a metal fiber agglomerate comprising fibers with an equivalent diameter of between 1 μm and 30 μm and with a length of between 1 mm and 20 mm, with the feature that the core of the agglomerate contains at least one bundle of fibers oriented substantially parallel to one another, while the casing consists of a network of randomly oriented fibers. The invention also relates to a process for the manufacture of these metal fiber agglomerates, characterized by a succession of steps in which the agglomerate is subjected to a continuous tumbling movement.

6 Claims, 1 Drawing Sheet

METAL FIBRE AGGLOMERATE AND PROCESS FOR MANUFACTURING THE SAME

The invention relates to a metal fibre agglomerate to be used for example in the production of metal fibre suspensions or in the production of metal fibre webs utilizing the wet method, and to a process for manufacturing the same.

For the production of suspensions containing metal fibres, metal fibre agglomerates are needed which are easy to handle and meter, and in which the metal fibres are entangled as little as possible with one another so that they can go into suspension easily and uniformly. Conventionally, these suspensions are produced starting from loose fibres or fibre granules in which the fibres are held together by a glue that is dissolvable in the suspension medium, such as PVOH (polyvinyl alcohol) in water.

A known method for producing these fibres consists of continuously pickling in nitric acid a composite comprising a bundle of stainless steel fibres in an iron-copper matrix, as described in U.S. Pat. No. 2,050,298. Then the bundle is impregnated, for example, with PVOH. The composite thus obtained is then cut into granules and marketed either as such or as loose fibres after the glue has been dissolved, as described in U.S. Pat. No. 3,977,069, column 4, line 5 through 29.

Loose fibres, however, are difficult to handle and meter.

Moreover, the preparation of a homogeneous fibre suspension starting from loose metal fibres presents major problems. On the other hand, when using the aforementioned granules it is nearly impossible in practice to completely remove the glue, which fact can cause problems in the production of metal fibre webs utilizing the wet method and, more in particular, in the sintering of the metal fibre web afterwards.

The specific terms which are used in the following description will now be explained. "Fe/Cu/SS" composite is understood to mean a bundle of stainless steel fibres which fibers are each enveloped in copper, the bundle itself being enveloped in an iron casing. The "equivalent diameter of the metal fibre agglomerate" is the diameter of an imaginary spherical agglomerate with the same volume as the ellipsoidal agglomerate obtained according to the invention.

The "equivalent diameter of a fibre" is the diameter of an imaginary round fibre with the same cross-sectional surface area as the actual fibre. It is an object of the invention to provide a metal fibre agglomerate which can be handled and metered, and which can be utilized, for example, in the production of homogeneous metal fibre suspensions and in the production of metal fibre webs utilizing the wet method.

In addition, it is an object of the invention to provide a process for manufacturing these metal fibre agglomerates.

More specifically, the invention provides a metal fibre agglomerate comprising fibres with an equivalent diameter of between 1 $\mu$m and 30 $\mu$m and with a length of between 1 mm and 20 mm, with the feature that the core of the agglomerate contains at least one bundle of fibres oriented substantially parallel to one another, while the casing consists of a network of randomly oriented fibres.

The agglomerates have a relatively high porosity (and thus a low mass density) so that, when immersed in a liquid they settle down slowly, which fact promotes the suspendibility and homogeneity of the suspension obtained.

Since the core consists mainly of small bundles of substantially parallel, non-entangled fibres, these fibres easily separate from one another in order thus to go into suspension.

In addition, it is an object of the invention to provide a process for manufacturing these metal fibre agglomerates starting from a cut Fe/Cu/SS composite, and comprising the following steps:

(a) the chemical pickling with sulphuric acid of the iron casing around the cut composite;

(b) the subsequent electrolytic removal of the remaining iron casing and the copper casings of the composite;

(c) the rinsing of the fibres with dilute sulphuric acid;

(d) the rinsing of the fibres with water; (e) the drying of the fibres, with the substrate continuously subjected to a tumbling movement in steps (a) through (d).

Such a discontinuous process in which the substrate (e.g. fibres, fibre agglomerates, composite) is subjected to a tumbling movement is in general very suitable for carrying out pickling operations and for the leaching, for example, of coatings on these different substrates. These operations are regularly utilized in industry. Leaching is also utilized, for example in the manufacture of metal fibres with a diameter of up to 100 $\mu$m by shaving the edge of a polymer-coated metal foil.

An alternative process for manufacturing the metal fibre agglomerates according to the invention consists of washing the conventional metal fibre granules (i.e. metal fibre bundles impregnated with glue) in a glue-dissolving medium in a drum for the purpose of removing the glue. By subjecting the granules to a continuous tumbling movement during washing, the glue is to a large extent removed and the fibres that come loose and separate end up being clung and bunched together into the intended fibre agglomerate balls.

The invention will now be explained with reference to certain specific embodiments, which are illustrated in the accompanying drawings.

Figure 1:
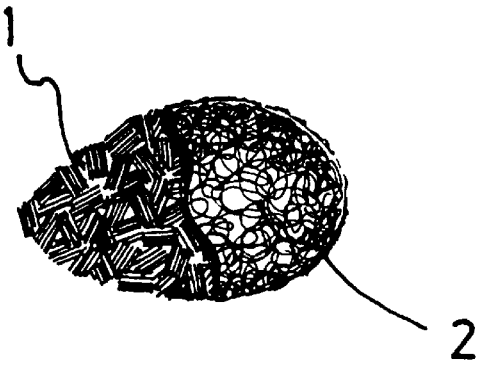
FIG. 1 is a schematic representation of the metal fibre agglomerate according to the invention.

The metal fibre agglomerate according to the invention is represented in FIG. 1. The core 1 of the agglomerate consists of a number of bundles of fibres oriented substantially parallel to one another. The casing 2 of the agglomerate, on the other hand, is composed of a network of randomly oriented fibres. In order to form a clear picture of the agglomerate, a part of the casing is cut away in FIG. 1.

Figure 2:
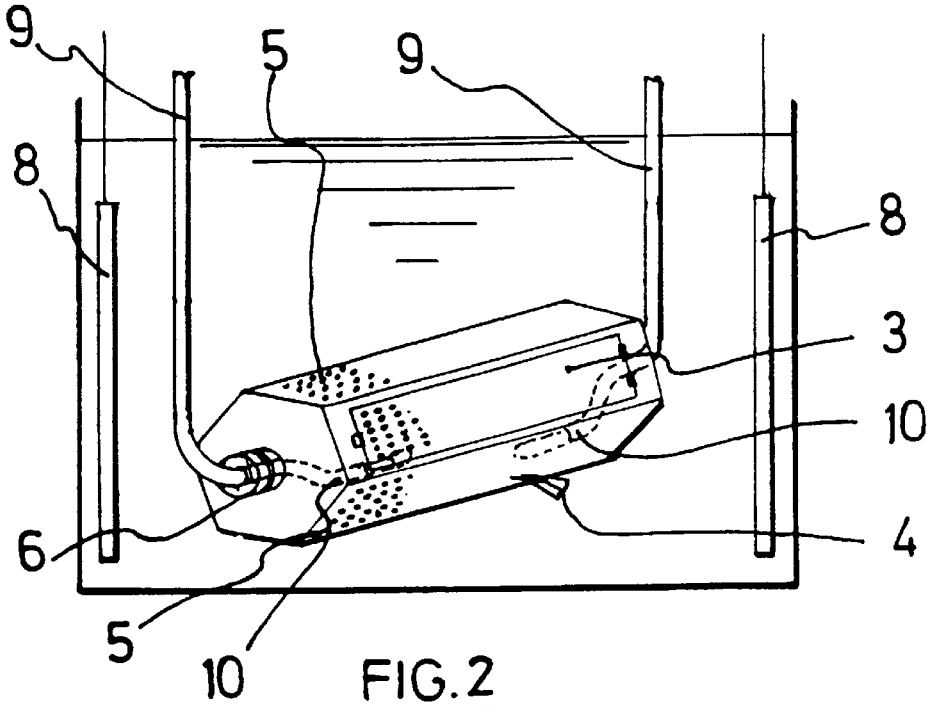
FIG. 2 is a schematic representation of the drum in the electrolytic pickling bath.
Figure 3:
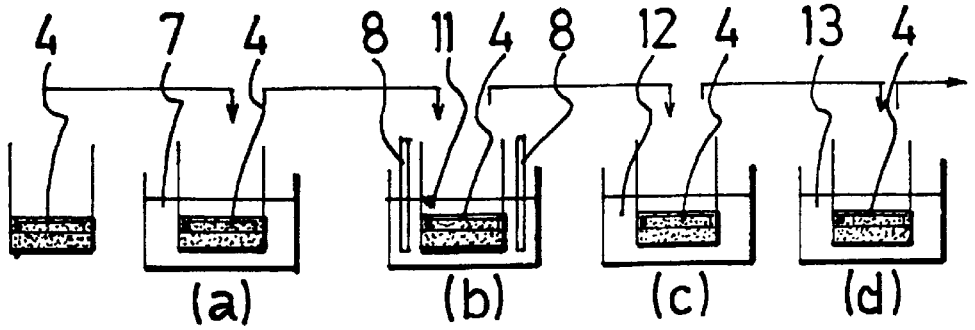
FIG. 3 is a schematic representation of the consecutive steps in the production process.

One possible process for manufacturing the metal fibre agglomerates described is presented schematically in FIGS. 2 and 3. This production method consists of discontinuously pickling cut Fe/Cu/SS composite in sulphuric acid using a drum made of a plastic such as polypropylene. The drum is placed in the pickling bath and can be rotated at an adjustable speed around its longitudinal axis by means of an outside motor. In addition, the drum can be subjected to a vertical translational motion in order to improve the circulation of the electrolyte into and out of the drum.

The cut composite can be put into the drum 4 through a cover 3. The wall of the drum is provided with holes 5, which provide for good circulation of the electrolyte (sulphuric acid) through the drum space. To prevent the cut composite from escaping from the drum through these holes, a filter cloth is provided (not shown in the figure). The filter cloth can be mounted along the outside of the drum, or it can be clamped in between the internal wall of the drum and an external perforated plate.

A plasticized flexible copper cable 9 with the titanium anode 10 at its end can be put into the drum through openings 6 in the end wall of the drum. An alternative to this method consists in using metal discs as anode, which are mounted against the flat sidewalls of the drum, and in which the current is transmitted via a sliding contact.

A concrete embodiment of this process will be explained in the following example. The process conditions mentioned relate to the pickling of 3 kg Fe/Cu/SS composite obtained by means of the known method of bundled drawing. The different steps of the process will be described in detail with reference to FIGS. 2 and 3.

In the first step A of the pickling process, the iron casing is completely or partially removed chemically by pickling, with the release of hydrogen gas.

To do this, the drum 4 is placed in a sulphuric acid bath 7 and continuously rotated in this bath for at least 20 minutes. The concentration of sulphuric acid in the bath is 300 g/l and the temperature is 50° C. The sulphuric acid reacts immediately (without the application of an electrical current) with the iron casing of the Fe/Cu/SS composite. Hydrogen gas and iron (II) sulphate are formed.

Subsequently, in the second step B of the process, any residual iron casing and copper is electrolytically removed. A lead cathode 8 and a titanium anode 10 are used for this purpose. A plasticized flexible copper cable 9 with the titanium anode at its end is put through an opening 6 in the end walls of the drum. The lead cathode 8 is immerged in the pickling bath.

The drum is continuously rotated in a sulphuric acid bath 11. The rotation provides for good circulation of the acid and thus maintains the electrical current. The dwell time of the composite in the bath 11 depends on the current, the amount of composite and the extent to which the iron casing has already been pickled during the first step A of the process. In the present example, the pickling is done for a minimum of 3.5 hours with a current of 50 A to dissolve the copper casing from the composite.

In the third step C the composite is washed in dilute sulphuric acid in order to prevent the subsequent formation of iron hydroxide in the fourth step. The drum is rotated for 15 to 30 minutes in the bath 12. In addition, the drum is subjected to a vertical translational motion in order to improve the circulation of the fluid in the drum.

In the fourth step D the fibres are washed with water. The drum is rotated a number of hours in the water bath 13.

In the last step E the fibres are taken out of the drum and dries in an oven.

Starting with fibres having an equivalent diameter of between 1 $\mu$m and 30 $\mu$m, and a length of between 1 mm and 20 mm, on the basis of the process described, agglomerates are obtained which contain between $2.10^4$ and $2.10^6$ fibres. The dimensions of the agglomerates obtained depend on the dimensions of the fibres used. The variation of the average equivalent diameter of the agglomerates obtained runs through a maximum depending on the ratio of the length of the fibres utilized to their equivalent diameter (L/D). If fibres with an L/D ratio of 400 are used, then agglomerates with an average equivalent diameter of 1 cm are obtained. Similarly, agglomerates with an average equivalent diameter of 2 cm are obtained from fibres having an L/D ratio of 750. In order to produce the metal fibre agglomerates with the process herein described, the L/D ratio of the fibres used should by preference be between 100 and 2000.

The density of the agglomerates depends on the geometry of the fibres utilized and is generally less than 0.8 kg/dm$^3$. In this manner agglomerates are obtained having a density of 0.19 kg/dm$^3$, starting with fibres having an equivalent diameter of 6.5 $\mu$m and a length of 1 mm.

If steps A and B of the process are carried out in the same pickling bath without replacing the electrolyte, the waste acid will contain $H_2SO_4$, $FeSO_4$ and $CuSO_4$. In the process described, in which steps A and B are carried out in separate pickling baths, the waste acid from step A will contain only $H_2SO_4$ and $FeSO_4$ (and neither Cu nor $CuSO_4$), which is beneficial for its further processing. After the electrolytic pickling, the waste acid consists of $H_2SO_4$, $CuSO_4$ and $FeSO_4$ (as a result of possible remainders of the iron casing, if this casing was not totally dissolved during step A) and Cu (as a result of deposition on the cathode).

Furthermore, it is an advantage of the process herein described that the metal fibre agglomerates obtained contain fibres that are free of all glue, such as PVOH.

Another advantage of the process herein described is that no nitric acid is utilized in the pickling process, which is very favourable from an ecological point of view.

The pickling time in step B and the sulphuric acid concentration used are very critical process parameters. If the electrolytic pickling goes on too long or if a too high concentration of sulphuric acid is used, the fibres can be seriously corroded by the acid. It is especially in the pickling of Cu that the pickling time and sulphuric acid concentration are very critical.

Although the drum capacity is often limited, the total capacity of the process can be increased by putting several drums into operation simultaneously. Moreover, with an increase of the current during pickling it is possible to decrease the pickling time, which also increases the yield of the operation.

The metal fibre agglomerates according to the invention are very suitable, among other things, for use in the production of plastics containing an even distribution of metal fibres, which can be used for example in the generation of an electromagnetic shielding effect in the plastic products.

Furthermore, it is possible to add the metal fibre agglomerates according to the invention in given quantities to another fibre suspension. The metal fibres can thus be evenly dispersed and distributed among the other fibers. In this way, mixed fibre webs can be manufactured utilizing the wet method. By adding metal fibres evenly to a paper fibre suspension, sheets of paper are then obtained having a specific metal fibre content, these fibres being distributed uniformly throughout the paper, as described for example in U.S. Pat. No. 4,265,703.

In addition, the process can also be used for the pickling of a Fe/Fe/SS composite or a Fe/Fe/Fe/SS composite. In this case, waste acid will no more contain Cu, and the electrolytic pickling step is then omitted (step B in the process described above). An Fe/Fe/Fe/SS matrix is obtained by drawing a number of stainless steel wires each enveloped in Fe. These drawn wires are then bundled, enveloped in an iron casing and drawn. A number of the structures thus obtained are then in turn bundled together, enveloped in an iron casing and once again drawn to form the intended matrix, as described in U.S. Pat. No. 3,379,000.

The process described can be utilized for pickling any type of composite, even of short length, for example 0.1 mm. The fibres thus obtained can then be used, for example, in the production of radar camouflage coatings.

What is claimed is:

1. A metal fiber agglomerate having a core and a casing, said agglomerate comprising fibers with an equivalent diameter of between 1 $\mu$m and 30 $\mu$m and with a length of between 1 mm and 20 mm, wherein the core of the agglomerate contains at least one bundle of fibers oriented substantially parallel to one another, while the casing consists of a network of randomly oriented fibers.

2. A metal fiber agglomerate according to claim 1, in which the ratio of the length to the diameter of the fibers is between 100:1 and 2000:1.

3. A metal fiber agglomerate according to claim 1, wherein the agglomerate contains between $2\times10^4$ and $2\times10^6$ fibers.

4. A process for manufacturing metal fiber agglomerates according to claim 1, starting from a cut Fe/Cu/SS composite, and comprising the following steps:

(a) chemical pickling with sulphuric acid of the iron casing around the cut composite;

(b) subsequent electrolytic removal of the remaining iron casing and the copper casings of the composite;

(c) rinsing of the fibers with dilute sulphuric acid;

(d) rinsing of the fibers with water;

(e) drying of the fibers, and wherein the composite is continuously subjected to a tumbling movement in steps (a) through (d).

5. A process for manufacturing metal fiber agglomerates according to claim 1, in which metal fiber bundles impregnated with glue are washed in a glue-dissolving medium while being subjected to a continuous tumbling movement in order to remove the glue.

6. A process according to claim 5, wherein the glue is polyvinyl alcohol and the glue-dissolving medium is water.

* * * * *